US006351242B1

(12) United States Patent
Hesker

(10) Patent No.: US 6,351,242 B1
(45) Date of Patent: Feb. 26, 2002

(54) ANTENNA UNIT

(75) Inventor: Norbert Hesker, Ostbevern (DE)

(73) Assignee: Wilhelm Karmann GmbH, Osnabrueck (DE)

( * ) Notice: Subject to any disclaimer, the term of this patent is extended or adjusted under 35 U.S.C. 154(b) by 0 days.

(21) Appl. No.: 09/417,801

(22) Filed: Oct. 14, 1999

(30) Foreign Application Priority Data

Oct. 15, 1998 (DE) ..... 298 18 430 U

(51) Int. Cl.[7] ..... H01Q 1/32

(52) U.S. Cl. ..... 343/713; 343/711; 343/712; 343/873

(58) Field of Search ..... 343/711, 712, 343/713, 741, 872, 873

(56) References Cited

U.S. PATENT DOCUMENTS 4,723,127 A * 2/1988 Ohe et al. ..... 343/712
4,758,166 A * 7/1988 Bonnett et al. ..... 343/712
4,804,966 A * 2/1989 Ohe et al. ..... 343/712
4,987,422 A * 1/1991 Ryan ..... 343/713
5,629,712 A * 5/1997 Adrian et al. ..... 343/713
5,918,183 A * 6/1999 Janky et al. ..... 455/550
6,005,527 A * 12/1999 Gomez et al. ..... 343/713

FOREIGN PATENT DOCUMENTS

EP 0 339 822 A2 * 2/1989 ..... H01Q/1/52

* cited by examiner

*Primary Examiner*—Don Wong
*Assistant Examiner*—Shih-Chao Chen
(74) *Attorney, Agent, or Firm*—Jordan and Hamburg LLP

(57) ABSTRACT

An antenna unit has at least one transmitting unit and/or receiving unit, and is provided for installation in passenger cars below an outer wall of a car body component. The antenna unit comprises a common girder unit, which mechanically supports the antenna, disposed on the girder, independently of the car body of the vehicle. Further provided is a moveable two-dimensional car body component, such as a trunk lid or a hood, wherein the car body component consists at least regionally of plastic and comprises an antenna unit with at least one antenna, an electrical ground and a connecting interface for the antenna unit.

20 Claims, 7 Drawing Sheets

ANTENNA UNIT

BACKGROUND OF THE INVENTION

The invention relates to an antenna unit with at least one transmitting unit and/or receiving unit, provided for installation in passenger cars below the outer wall of a car body component, wherein the antenna unit comprises a common girder unit, which mechanically supports the antenna, disposed on the girder, independently of the car body of the vehicle, and further relates to a moveable two-dimensional car body component, especially a trunk lid or a hood, wherein the car body component consists at least regionally of plastic and comprises an antenna unit with at least one antenna, an electrical ground and a connecting interface for the antenna unit.

Modern automobiles have to be equipped with several antennas in order to be able to make use of different receiving and transmitting tasks, for example, for the operation of car radios, the telephone, a navigational system, a GPS as well as an emergency call system or an electronic toll detection, but also for a central locking system, a heating system that can be remote controlled as well as a distance control or the like.

The antennas, required for this purpose, have different constructions, such as rod antennas for radio and telephone, possibly replaced by window- or windshield-type antennas, dish antennas for homing in on a GPS, wire antennas and the like.

The rod antennas, which were customary for a long time and have a high efficiency, were replaced increasingly in the past by antennas integrated into the windshield and rear window because of their susceptibility to damage and vandalism as well as because of their interfering effect on air resistance and their high installation costs. In general, however, the efficiency is not as good. Moreover, the arrangement in the windshield and rear window interferes, since the antennas then limit the field of vision, as transmitting antennas emit electromagnetic radiation into the interior and, moreover, are close to the dashboards equipped with electronic instruments, as a result of which interference cannot be excluded. For rear window antennas, especially the rear window heater is a problem. In the case of convertibles, there is furthermore the problem that the rear window as well as the roof of the vehicle are not available for the antennas, so that only the windshield comes into consideration here for a window-mounted antenna.

The DE 196 36 584 C1 discloses the accommodation of one or more antennas in a plastic bumper. The antennas are fixed directly to the inside of the bumper. Because the shape of the antennas is adapted to the U-shaped outer form of the bumper, the number and construction of antennas is limited. Moreover, the position of the antennas in the bumper is a disadvantage in the case of accidents, since repair costs are increased appreciably.

SUMMARY OF THE INVENTION

It is therefore an object of the invention to dispose the vehicle antennas visually unobtrusively and with the lowest possible installation costs and, at the same time, a high crash safety.

The present invention solves the aforesaid problems by providing an antenna unit an antenna unit with at least one transmitting unit and/or receiving unit, provided for installation in passenger cars below the outer wall of a car body component, wherein the antenna unit comprises a common girder unit, which mechanically supports the antenna, disposed on the girder, independently of the car body of the vehicle.

A feature of the present invention provides that the girder additionally carries electronic components and connecting elements of the antenna supported at these.

A further feature of the present invention provides that the antenna unit has a modular construction and can be equipped with a different number of antennas.

According to a still further feature of the invention, it is further provided that the girder forms a wall part of a multi-shell car body part, which accommodates the antenna unit in the installed state.

Yet another feature of the invention provides that the antenna unit can be connected over a central interface with a continuing connection line.

Still another feature of the invention provides that, in the installed state, the girder is fixed between an outer and an inner shell of the car body component and fixed to one of these shells.

Another feature of the present invention includes the characteristic that the car body part consists of a plastic, particularly of an SMC plastic or a thermoplastic material.

According to a still further feature of the invention, there is further provided an antenna unit as described above, characterized in that the girder is connected to a metal strap or film, which functions as an electrical ground and essentially runs around the edge region of the car body component.

The present invention also includes a moveable two-dimensional car body component, especially a trunk lid or a hood, wherein the car body component consists at least regionally of plastic and comprises an antenna unit with at least one antenna, an electrical ground and a connecting interface for the antenna unit.

Additionally the present invention provides the above car body component wherein the antenna unit is constructed as described above and comprises a basic support, which is to be pre-installed independently of the car body component for mechanically supporting the antennas.

Due to the antenna unit, embedding in a two-dimensional car body component, such as the hood or the trunk lid or the side doors, is possible. All antennas can be included in this antenna unit, beyond which, the vehicle does not require any further rod, window or windshield antennas. The antenna unit comprises a girder, which can be equipped with the antennas as well as electronic components and connectors before the car body is installed, so that the antenna unit as a whole can be supplied as a modular component of the installation. This completely pre-installed unit can be inserted in the car body component during the installation. This component can additionally be equipped with a peripheral grounding strap or grounding film. Overall, therefore, the cost of installing antennas in the vehicle is reduced appreciably.

Advantageously, the antenna is disposed in a component of the car body, which is similar for different vehicle types of a series (such as a coupe or a convertible). For this purpose, the trunk lid, for example, comes into consideration. The antenna unit can be connected over a central interface with the continuing cables of the motor vehicle.

It is furthermore advantageous if, in the case of multi-shell car body components, such as trunk lids, hoods or doors, the antenna unit is constructed either between the wall parts of this car body component or connected with a wall part. The wall parts or the antenna unit and the wall part can be connected by conventional means, such as screws, adhesives, welding or the like.

It is particularly advantageous if the antenna unit is constructed as a modular unit in such a manner that, depending on the equipment of the vehicle, it is provided with different numbers of antennas and can also be retrofitted, for example, by subsequently installing a remote control for a parking heater.

With the antenna unit, it is possible to pre-manufacture engine hoods, trunk lids or doors completely and to bring these into the production.

The above, and other objects, features and advantages of the present invention will become apparent from the following description read in conjunction with the accompanying drawings, in which like reference numerals designate the same elements. It is understood that the drawings are exemplary and not limiting.

BRIEF DESCRIPTION OF THE DRAWINGS

Further advantages and distinguishing features arise out of an example of the object of the invention, which is shown in the following in the drawing, in which.

DETAILED DESCRIPTION OF THE PREFERRED EMBODIMENT

Figure 1:
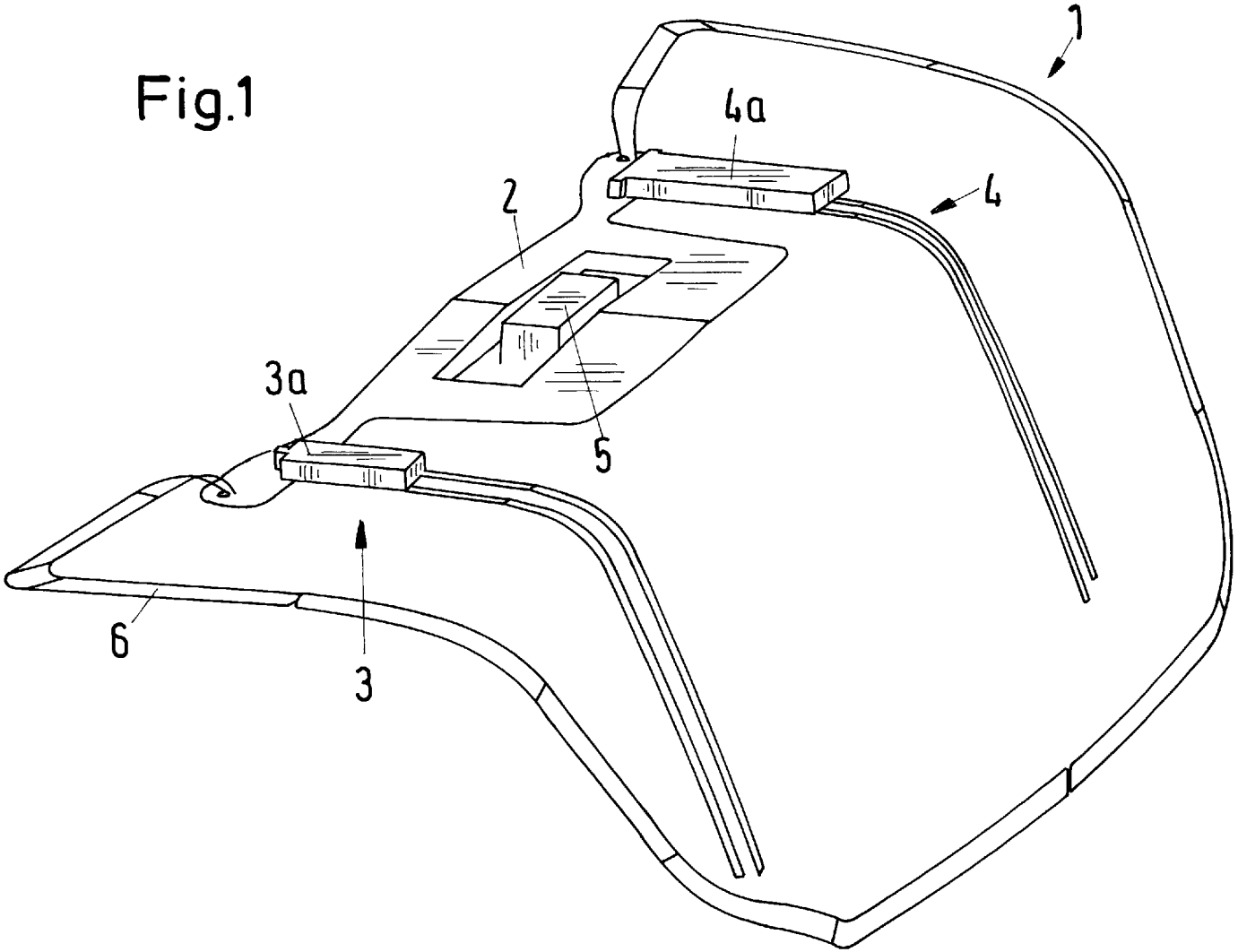
FIG. 1 shows an embodiment of an antenna unit of the present invention.
Figure 2:
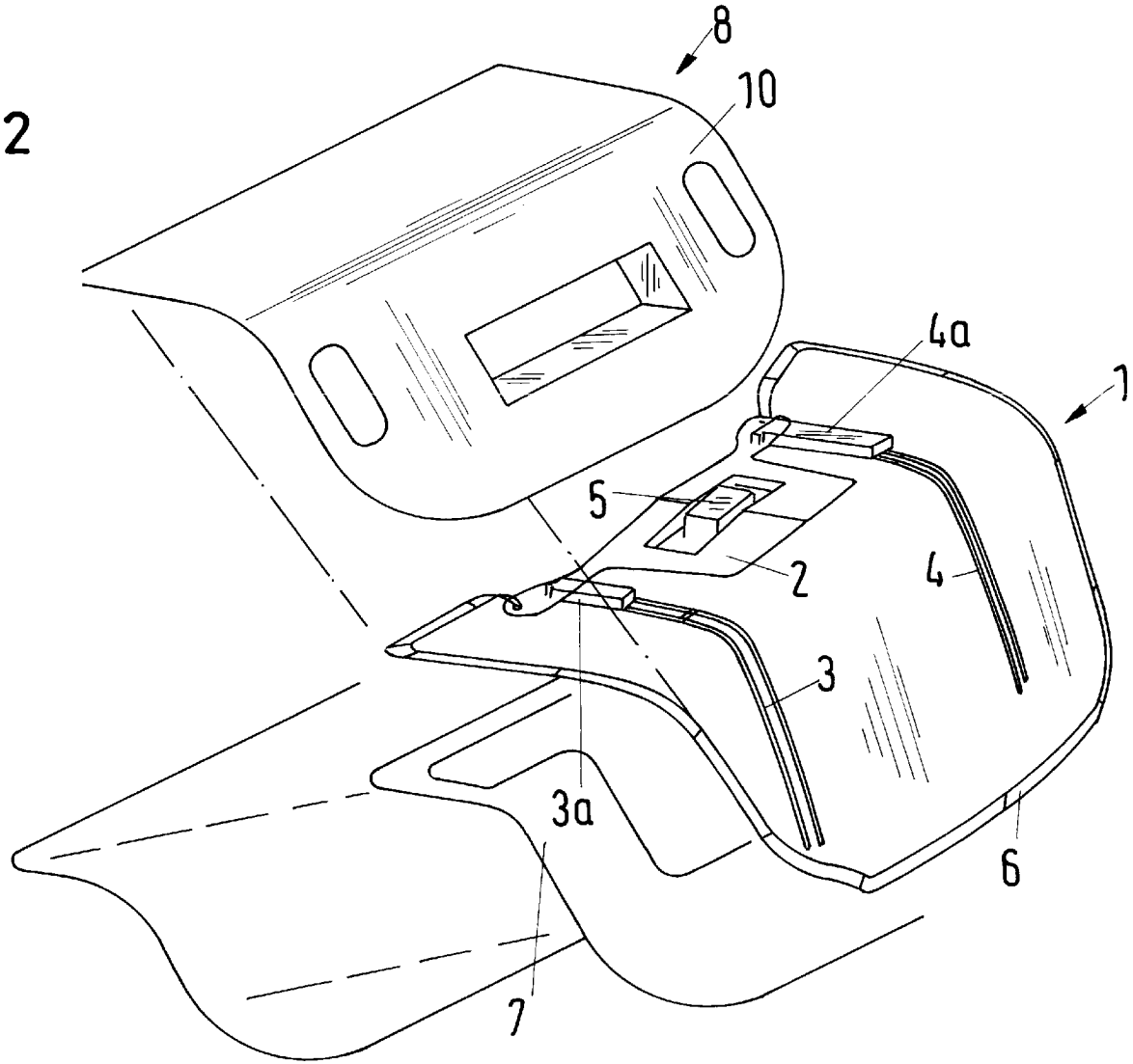
FIG. 2 shows the antenna unit installed between wall parts and a trunk lid.
Figure 3:
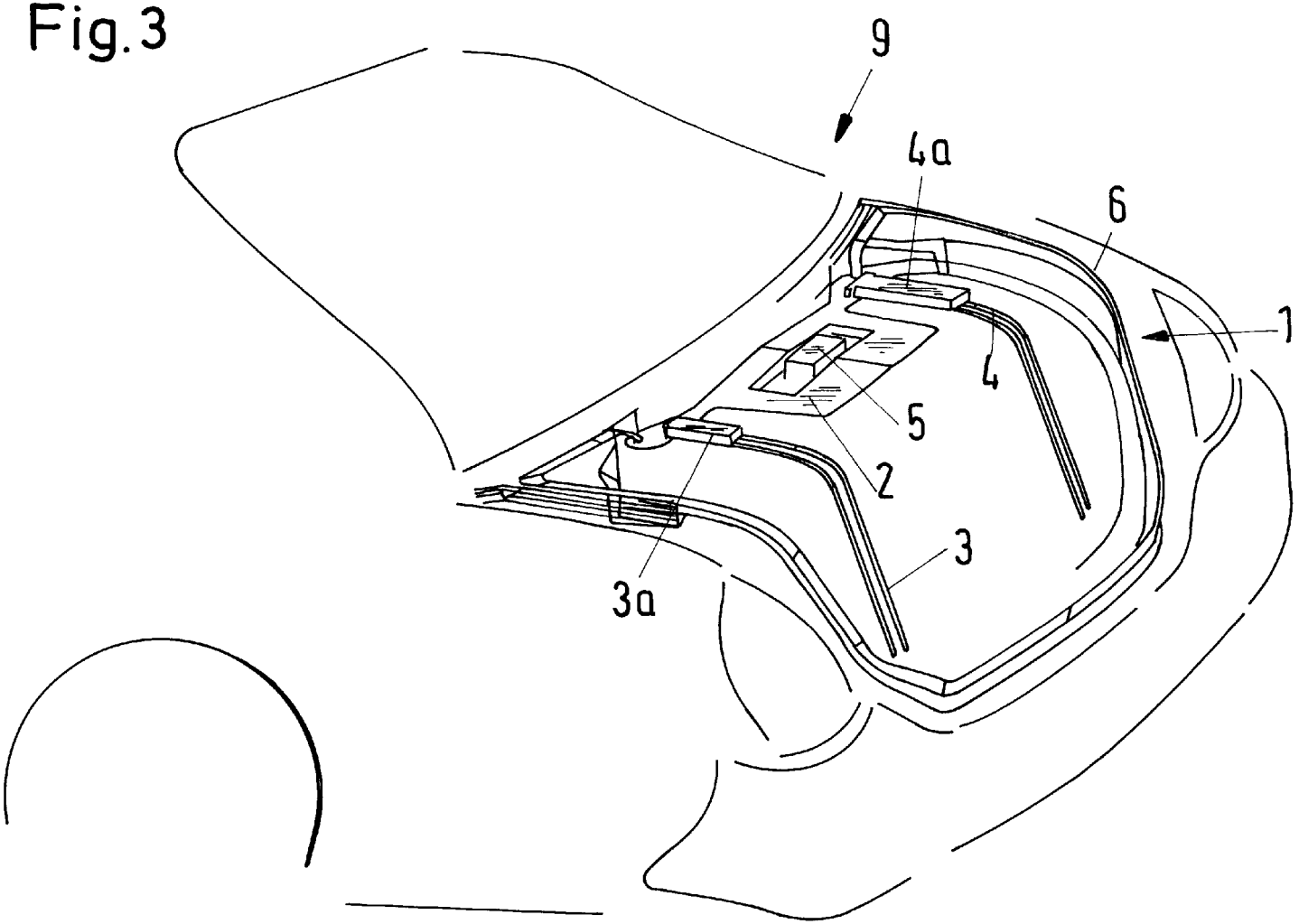
FIG. 3 shows a motor vehicle with an antenna unit integrated into its trunk lid.
Figure 4:
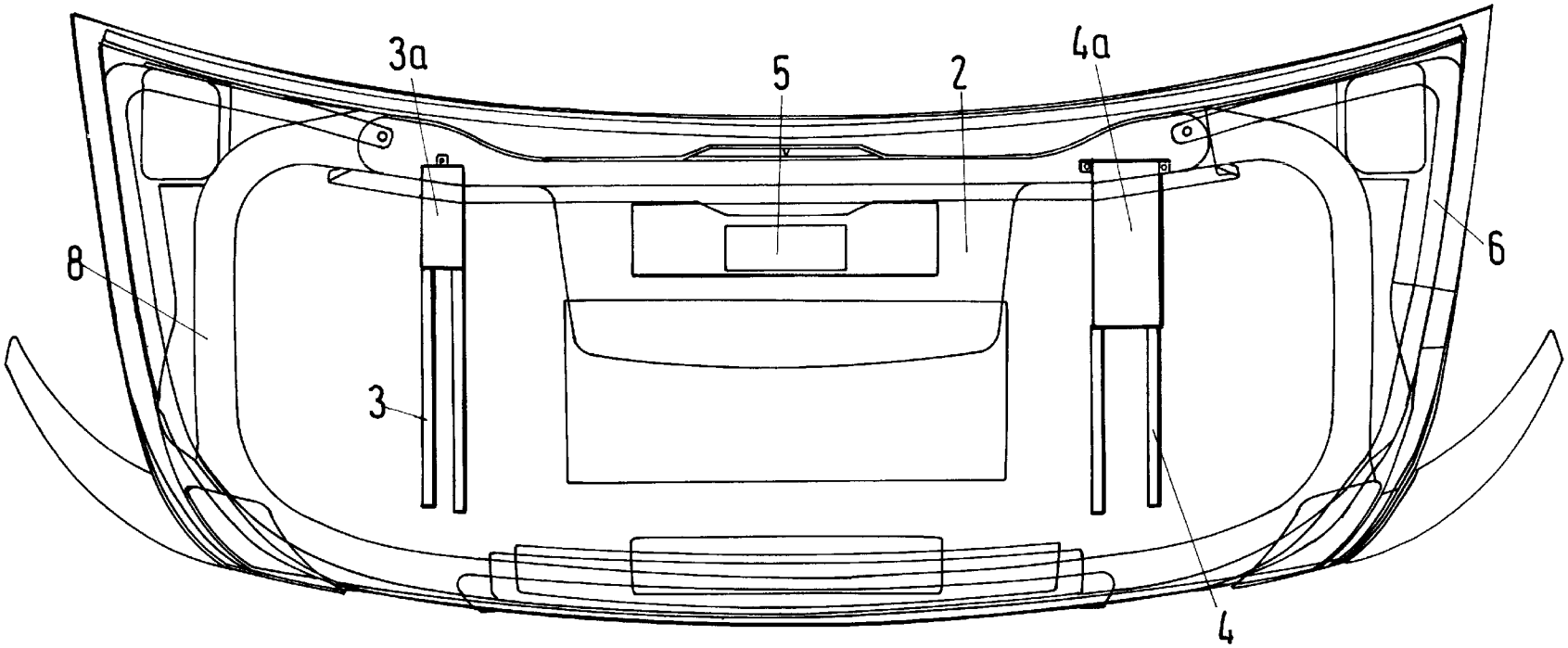
FIG. 4 shows a plan view of a rear region of the vehicle of FIG. 3.
Figure 5:
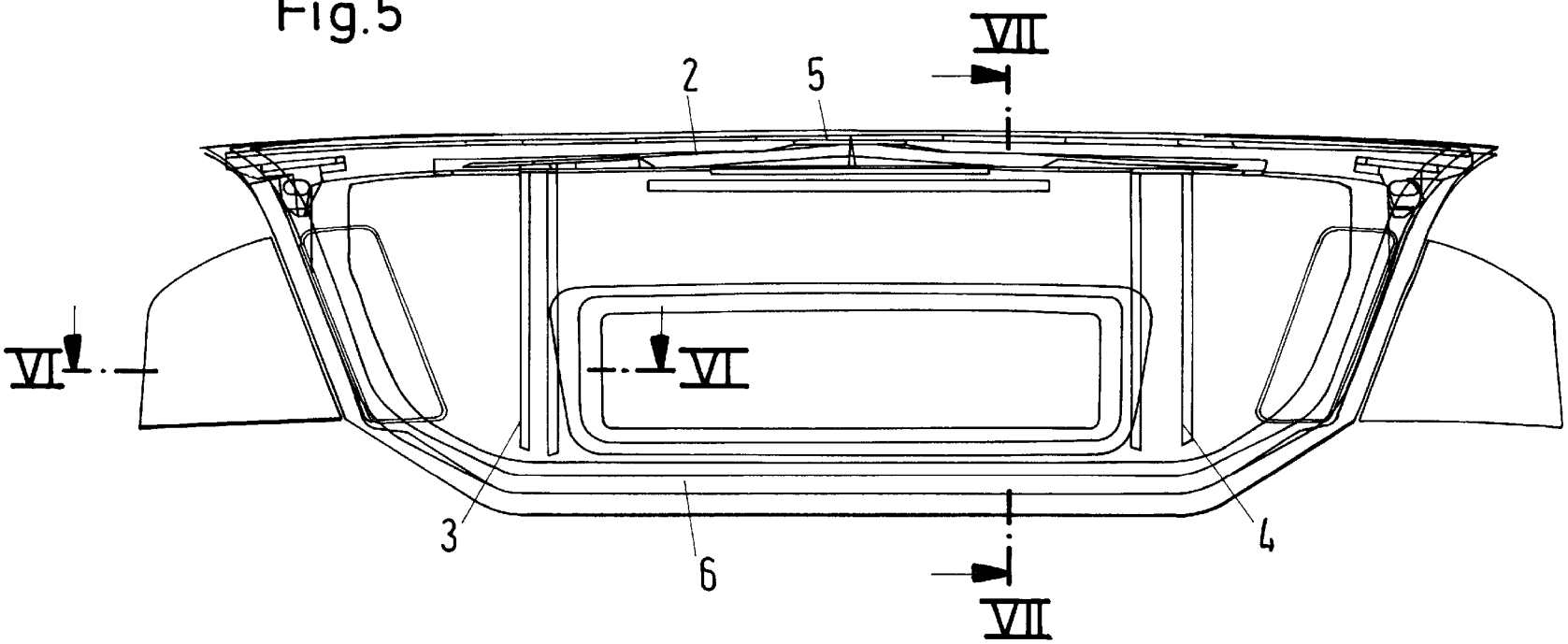
FIG. 5 shows a rear view of the trunk lid of FIG. 3.

Referring to FIG. 1, an antenna unit 1 comprises a girder 2, at which several antennas 3, 4, 5 can be disposed. In the example, the antennas 3 and 4 are constructed as rod antennas, antenna 5 represents a GPS receiver and transmitter, which is constructed as a dish antenna. Likewise, the electronic components 3*a*, 4*a*, such as the diversity and amplifier of a respective antenna 3, 4, are disposed at the girder 2. The antenna unit 1 can, moreover, contain a conductor 6, which is at a ground potential and, in the example, is connected electrically conducting with the girder 2 and surrounds the different antennas 3, 4, 5. Further ground leads, which can be placed between the antennas and shield these from one another, can also be provided. The conductor 6 can also be constructed independently of the antenna unit 1 and be connected with this unit only during the installation.

The girder unit 2 can represent a separate component and, for example, be constructed of a metal. It is also possible that the girder 2 forms part of an inner wall 7 of a multi-shell car body part 8 which also includes an outer wall 10, and that the antenna unit 1, pre-installed on the inner wall 7, is joined to the car body component 8 by welding, gluing, screwing or the like. A pre-installed component 1 is created, which is provided with the antennas, electronic and electrical connecting components and used as a complete structural unit in the installation. By these means, the installation becomes appreciably simpler. It is particularly advantageous to equip the whole of the antenna unit 1 with a single interface for electrical contacting, so that a single connector is sufficient for all antennas 3, 4, 5.

Furthermore, the girder 2 can be equipped with different connector places for antennas 3, 4, 5, so that a modular construction is achieved and retrofitting with further antennas at the girder 2 is possible, in order, for example, to make further remote-controlled functions at the vehicle possible.

Such antennas 3, 4, 5 can have different shapes and be constructed, for example, as rod antennas, dish antennas, wire antennas, etc.

Instead of a ground strap 6, a metallic film can also be mounted directly on the car body component 8, the latter consisting, for example, of a thermoplastic material or of an SMC plastic material.

An engine hood, a trunk lid or vehicle doors can also be provided directly with clip connectors or similar connecting elements for antennas, so that said car body parts 8 can function as basic supports 2. This may be appropriate if the car body components 8, equipped completely with the antenna unit, are to be installed in the vehicle 9 without high installation expenses.

Figure 6:
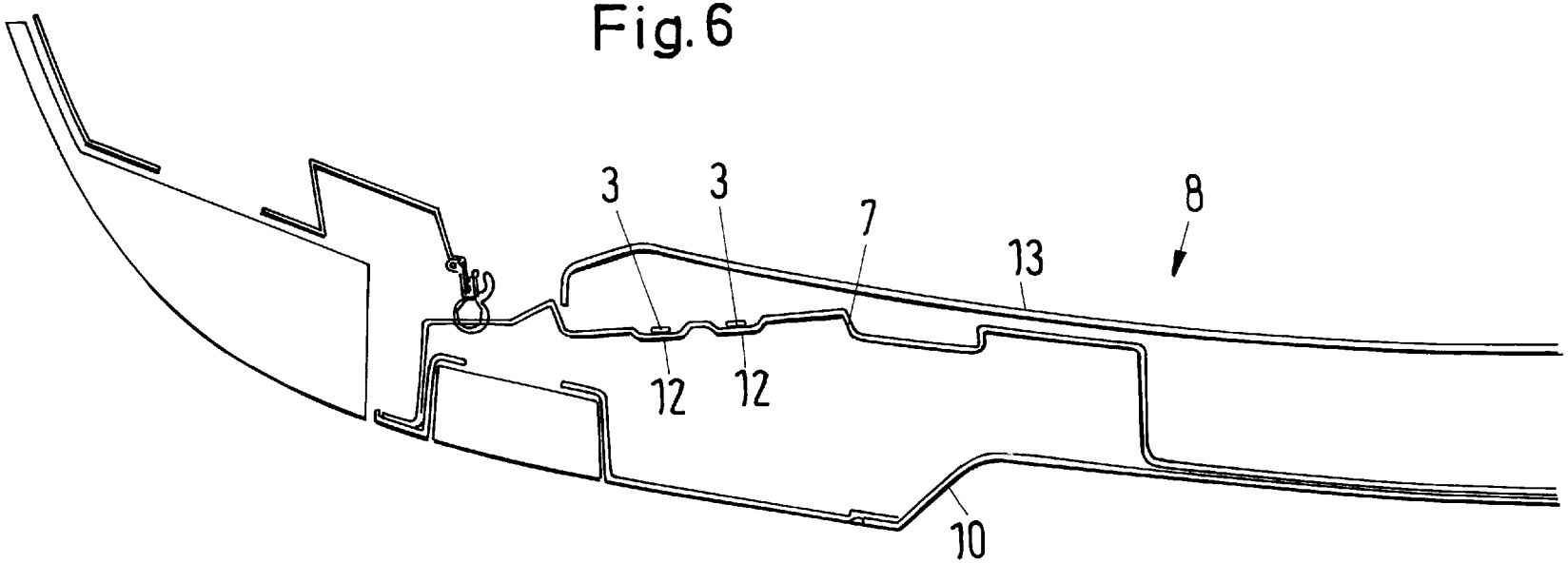
FIG. 6 shows a section along the line VI—VI in FIG. 5.

In each case, the antenna unit 1 is installed visually unobtrusively in the car body component 8, which usually is constructed multi-walled and protected against damage even in the case of a minor accident. The antennas 3, 4 and are not visible to the user and are protected against being damaged by luggage even when they are mounted in a trunk lid. As can be seen in FIG. 6, a wall 7 of the car body component 8, which is constructed as a trunk lid, can be provided with depressions or with other shape adaptations 12, for accommodating the antenna elements, in this case the rods of the rod antenna 3. These can, for example, be clipped to, glued with or otherwise fastened to the wall 7.

Figure 7:
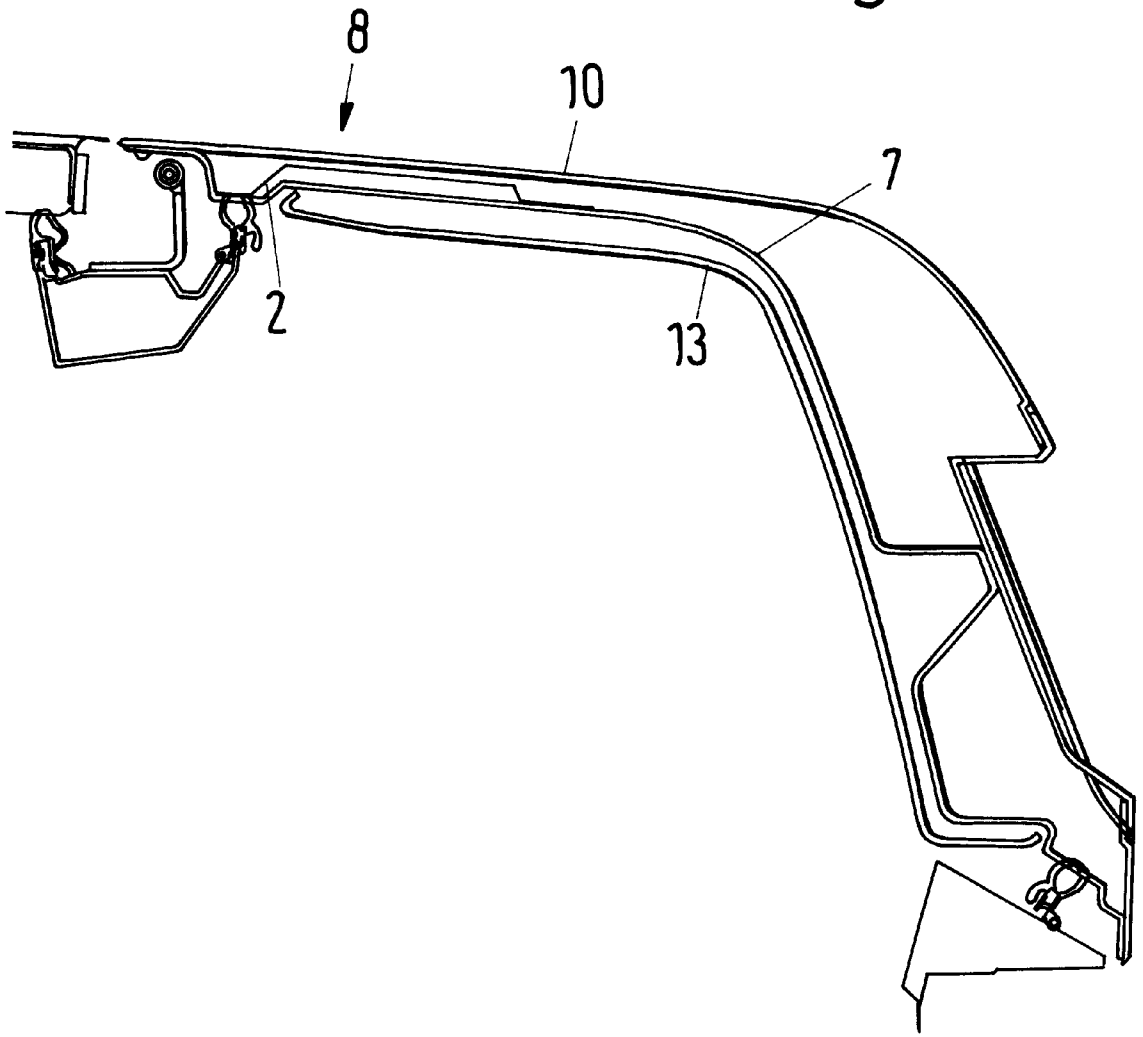
FIG. 7 shows a section along the line VII—VII in FIG. 5.

FIG. 7 shows a further inner lining 13 of the inner wall 7 of the car body component 8, by means of which a visually hidden position of the antenna unit 1 is ensured even in the case of mold openings. At the same time, access to the antenna unit 1 can easily be opened for service purposes.

What is claimed is:

1. An antenna unit to be disposed in a hollow space of a vehicle component between inner and outer walls of the vehicle component, said antenna unit comprising a structural support member connected to said vehicle component and disposed in said hollow space, said structural support member comprising an elongated girder extending in a longitudinal direction, at least one receiving and/or transmitting antenna component supported by said structural support member, said antenna component being disposed within said hollow space, said antenna component being a longitudinal extending component extending externally of and away from said structural support member into said hollow space, said antenna component being embedded within and concealed from view within said hollow space of said vehicle component.

2. The antenna unit according to claim 1 wherein a plurality of antenna components are supported by said structure support member and extend externally of and away from said structural support member into said hollow space.

3. The antenna unit according to claim 1 wherein said antenna component comprises an electronic operable device mounted on said structural support member and an elongated antenna receiver and/or transmittal element extending from said electronic operable device.

4. The antenna unit according to claim 3 wherein said electronic operable device is an amplifier.

5. The antenna unit according to claim 1 wherein said antenna unit further comprises an elongated metal ground member surrounding said antenna component.

6. The antenna unit according to claims 5 wherein said elongated metal ground is electrically connected to said structural support member.

7. The antenna unit according to claim 1 wherein said antenna component is a rod antenna.

8. The antenna unit according to claim 1 wherein said antenna component is a wire antenna.

9. The antenna unit according to claim 1 wherein said antenna component is a dish antenna.

10. The antenna unit according to claim 1 wherein said antenna component comprises a navigational system antenna.

11. The antenna unit according to claim 1 wherein said antenna component comprises a telephone antenna.

12. An antenna unit to be disposed in a hollow space of a vehicle component between inner and outer walls of the vehicle component, said antenna unit comprising a structural support member connected to said vehicle component and disposed in said hollow space, at least one receiving and/or transmitting antenna component supported by said structural support member, sad antenna component being disposed within said hollow space and extending externally of and away from said structural support member, said antenna unit being embedded within and concealed from view within said hollow space of said vehicle component, said structural support member comprising an elongate d girder extending in a longitudinal direction, said antenna component being a longitudinal extending antenna component extending generally perpendicular to the longitudinal extending direction of said girder.

13. The combination of a vehicle component and an antenna concealed within the vehicle component comprising a vehicle component structure having inner and outer walls and a hollow space between said inner and outer walls, an antenna unit including a structural support member and at least one receiving and/or transmitting antenna component, said structural support member being mounted on said vehicle component and being disposed in said hollow space, said antenna component being supported by said structural support member and extending externally of and away from said structure support member into said hollow space, said antenna component being embedded within and concealed from view within said hollow space of said vehicle component structure.

14. The combination according to claim 13 wherein said vehicle component structure has spaced first and second opposite edge regions, said structural support member being disposed juxtaposed to said first edge region, said antenna component extending from said structural support member to a distance closer to said second edge region than to said first edge region.

15. The combination according to claim 13 further comprising a connection for connecting said antenna component to one of said walls of said vehicle component structure.

16. The combination according to claim 13 wherein said vehicle component structure is made of a plastic material.

17. The combination according to claim 13 wherein said vehicle component structure has edge regions, said antenna unit including an elongated metal ground member disposed within said hollow space along at least some of said edge regions of said vehicle component structure.

18. The combination according to claim 17 wherein said ground member surrounds said antenna component.

19. The combination according to claim 17 wherein said ground member is electrically connected to said structural support member.

20. The combination of a vehicle component and an antenna concealed within the antenna component comprising a vehicle component structure having inner and outer walls and a hollow space between said inner and outer walls, and at least one receiving and/or transmitting antenna component supported by said vehicle component structure and extending into said space between said inner and outer walls, said antenna component being embedded within and concealed from view in said hollow space of said vehicle component structure.

* * * * *